United States Patent [19]

Terauchi

[11] Patent Number: 4,784,045

[45] Date of Patent: Nov. 15, 1988

[54] WOBBLE PLATE TYPE COMPRESSOR WITH DRIVE SHAFT EXTENDING INTO CYLINDER BLOCK

[75] Inventor: Kiyoshi Terauchi, Gunma, Japan

[73] Assignee: Sanden Corporation, Gunma, Japan

[21] Appl. No.: 100,235

[22] Filed: Sep. 23, 1987

[30] Foreign Application Priority Data

Sep. 26, 1986 [JP] Japan ..... 61-146575[U]

[51] Int. Cl.[4] ..... F01B 3/02; F04B 27/08

[52] U.S. Cl. ..... 92/71; 417/269; 74/60

[58] Field of Search ..... 417/269; 92/71; 91/507; 74/60

[56] References Cited

U.S. PATENT DOCUMENTS

| | | | |
|---|---|---|---|
| Re. 27,844 | 12/1973 | Olson, Jr. | 417/269 |
| 2,365,309 | 12/1944 | Talbot | 417/269 X |
| 3,151,527 | 10/1964 | Hamlin | 74/60 X |
| 3,663,122 | 5/1972 | Kitchen | 417/269 |
| 3,712,759 | 1/1973 | Olson, Jr. | 417/269 |
| 3,838,942 | 10/1974 | Pokorny | 417/269 |
| 3,861,829 | 1/1975 | Roberts et al. | 417/270 |
| 3,945,765 | 3/1976 | Toyoda et al. | 417/269 |
| 4,005,948 | 2/1977 | Hiraga et al. | 417/269 |
| 4,095,921 | 1/1978 | Hiraga et al. | 417/269 |
| 4,106,354 | 8/1978 | Girodin | 74/60 |
| 4,236,878 | 12/1980 | Terauchi | 417/269 |
| 4,301,716 | 11/1981 | Saegusa et al. | 417/269 X |
| 4,444,549 | 4/1984 | Takahaski et al. | 417/269 |
| 4,480,964 | 11/1984 | Skinner | 417/270 X |
| 4,526,516 | 7/1985 | Swain et al. | 417/270 X |
| 4,594,055 | 6/1986 | Hatakeyama et al. | 417/269 |
| 4,632,640 | 12/1986 | Terauchi | 417/269 |
| 4,664,404 | 5/1987 | Terauchi | 417/270 |
| 4,693,674 | 9/1987 | Fukai et al. | 417/269 |
| 4,697,992 | 10/1987 | Hatakeyama et al. | 417/269 |

FOREIGN PATENT DOCUMENTS

| | | | |
|---|---|---|---|
| 2153922 | 1/1985 | United Kingdom | 417/222 |

*Primary Examiner*—Paul F. Neils

*Attorney, Agent, or Firm*—Banner, Birch, McKie & Beckett

[57] ABSTRACT

A wobble plate type compressor is disclosed which includes a compressor housing having a crank chamber and a cylinder block which is provided with an axial center bore and a plurality of cylinders. A plurality of pistons are slidably fitted within each of the cylinders. A cam rotor is disposed within the crank chamber to rotate together with a drive shaft. A wobble plate is coupled to the pistons through each connecting rod. The wobble plate is disposed on the inclined surface of the cam rotor to convert rotating motion of the cam rotor into reciprocating motion to be imparted to the pistons while preventing the rotational motion of the wobble plate. A first bevel gear is non-rotatably disposed within the center bore of the cylinder block. A second bevel gear is fixed on the wobble plate and engaged with the first bevel gear through spherical member to prevent rotating of the wobble plate. The drive shaft extends within the first and second bevel gears and spherical member, and is supported on the first bevel gear. Therefore, the drive shaft is rotated without deflection and offset, and vibration and noise is reduced.

8 Claims, 1 Drawing Sheet

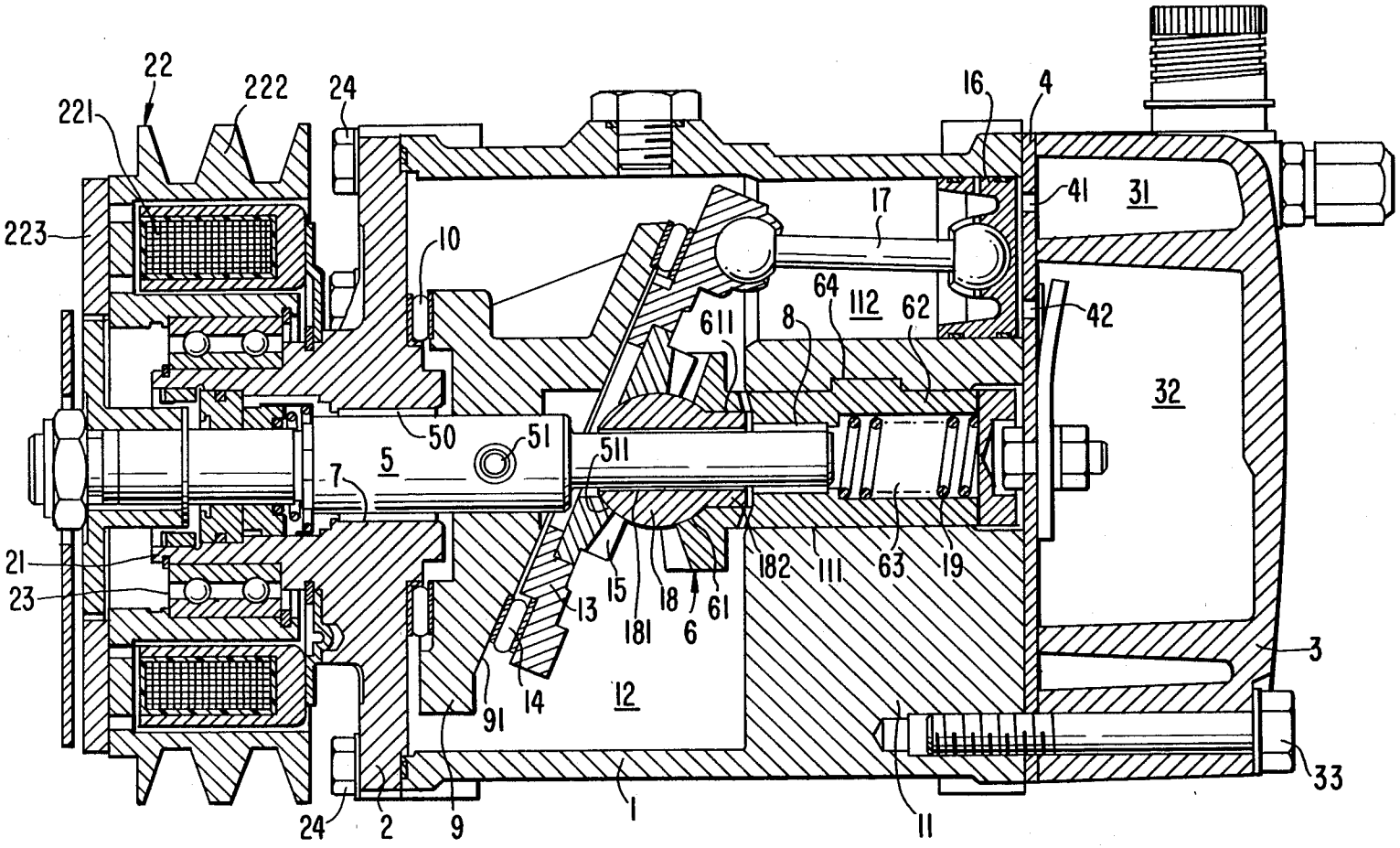
3
33
32
31
42
41
4
16
19
62
63
11
17
112
64
111
8
182
61
611
6
18
181
12
1
15
511
13
14
51
91
9
10
50
5
2
24
7
24
222
22
221
223
21
23

WOBBLE PLATE TYPE COMPRESSOR WITH DRIVE SHAFT EXTENDING INTO CYLINDER BLOCK

TECHNICAL FIELD

The present invention relates to a refrigerant compressor, and more particularly, to a wobble plate type compressor with an improved rotation preventing mechanism.

BACKGROUND OF THE INVENTION

Wobble plate type compressors are well-known in patent literature, e.g., in U.S. Pat. Nos. 3,552,886, and 3,712,759. The above-mentioned compressors include a compressor housing, a front end plate which is attached to one end opening of the compressor housing and a rear end plate in the form of a cylinder head. A crank chamber and a cylinder block are defined on the compressor housing. A drive shaft extends to the interior of the crank chamber from the outside through the front end plate. A wedge-shaped cam rotor is fixed on the inner end of the drive shaft. A wobble plate is disposed on an inclined surface of the cam rotor through a thrust bearing, and also nutatably supported on a steel ball disposed on a terminal end of a ball socket, which is not rotatably disposed within a central hole of the cylinder block. The rotating motion of the wobble plate is prevented by engagement of a bevel gear fixed within the wobble plate with a bevel gear formed on the terminal end of the ball socket.

In such wobble plate compressors, the drive shaft is rotatably supported within the front end plate through a journal bearing. The drive shaft is also supported by a thrust bearing disposed between an inner end surface of the front end plate and an axial end surface of the cam rotor. However, since the drive shaft is supported in a cantilever manner, if the compressor is driven under the condition of high load, such as high discharge pressure or high suction pressure, there is a possibility of the journal bearing or thrust bearing being destroyed or separated. In particular, when the angle of the inclined surface of the cam rotor is large, the possibility of destruction or separation tends to increase. Therefore, the angle of the inclined surface of the cam rotor can not be freely selected. Furthermore, the load of compression usually acts eccentrically on the journal bearing and the thrust bearing, thereby requiring the use of a high strength bearing. Such a bearing is relatively high in cost. Also, the above eccentric load is supported by only the driving mechanism, so the deflection and offset of driving parts may easily occur, thereby making it difficult to reduce vibration and noise of the compressor.

SUMMARY OF THE INVENTION

It is a primary object of this invention to provide a wobble plate type compressor with a rotation preventing mechanism which has high durability.

It is another object of this invention to provide a wobble plate type compressor with a rotation preventing mechanism which is low in cost.

It is another object of this invention to provide a wobble plate type compressor with a rotation preventing mechanism which does not generate large vibration and noise.

It is the other object of this invention to provide a wobble plate type compressor with a rotation preventing mechanism which is lightweight.

A wobble plate type compressor according to this invention includes a compressor housing having a crank chamber and a cylinder block provided with an axial center bore and a plurality of cylinders which are axially equiangularly formed around the center bore. A front end plate is attached to one end opening of the compressor housing. A cylinder head is attached to the other end of the compressor housing to cover the end surface of the cylinder block. A plurality of pistons are slidably fitted within each of the cylinders. A wedge-shaped cam rotor is disposed within the crank chamber and fixed on a drive shaft. A wobble plate is coupled to the pistons through connecting rods, and disposed on the inclined surface of the cam rotor to convert rotating motion of the cam rotor into reciprocating motion of the pistons. A first bevel gear is non-rotatably disposed within the crank chamber in alignment with the center bore of the cylinder block. A second bevel gear is fixed to the wobble plate. The first and second bevel gears have first and second ball seat portions, respectively. The drive shaft extends through the cam rotor and wobble plate to be rotatably supported in the center bore. A spherical member is carried on the drive shaft in the crank chamber, and the first and second ball seat portions of the bevel gears are disposed on the spherical member. The first and second bevel gears intermesh with one another so that the rotation of the second bevel gear and the wobble plate is prevented by the non-rotatably first bevel gear.

Further objects, features and other aspects of this invention will be understood from the following detailed description of the preferred embodiment of this invention referring to the attached drawing.

BRIEF DESCRIPTION OF THE DRAWINGS

The FIGURE is a cross-sectional view of a wobble plate type compressor in accordance with one embodiment of this invention.

DETAILED DESCRIPTION OF THE PREFERRED EMBODIMENT

Referring to the FIGURE, a wobble plate type compressor in accordance with one embodiment of this invention is shown. The compressor comprises a compressor housing 1 having a cylinder block 11 in one end portion thereof, a hollow portion, such as crank chamber 12 at the other end portion, a front end plate 2 and a cylinder head 3.

Front end plate 2 is mounted on one end opening of crank chamber 12 by a plurality of screws 24, and cylinder head 3 together with valve plate 54 is mounted on one end portion of cylinder block 12 by a plurality of screws 33 (one of which is shown in the FIGURE to form a closed housing assembly for the compressor. Opening 50 is formed in front end plate 2 and a drive shaft 5 is rotatably supported by a bearing means, such as radial needle bearing 7 which is disposed in the opening. Front end plate 2 has an annular sleeve portion 21 projecting from the front surface thereof for surrounding drive shaft 5 to define a shaft seal cavity.

An electromagnetic clutch 22 is disposed on annular sleeve portion 21 and connected to outer end portion of drive shaft 5 to transmit rotating motion. Electromagnetic clutch 22 preferably comprises a rotor 222 rotatably supported on annular sleeve portion 21 through a ball bearing 23, an electromagnetic coil 221 fixed on front end plate 2, and an armature plate 223.

Inside the housing, drive shaft 5 is attached to a wedge-shaped cam rotor 9 through a pin element 51, so that cam rotor 9 is rotated along with drive shaft 5. A thrust needle bearing 10 is disposed between the inner end surface of front end plate 2 and the adjacent axial end surface of cam rotor 9. Sloping surface 91 of cam rotor 9 is placed in close proximity to the surface of a wobble plate 13, which is mounted on an oscillating bevel gear 15. Oscillating bevel gear 15 is able to nutate or oscillate about a spherical member, such as ball bearing element 18, seated within a fixed bevel gear 6. The engagement of bevel gears 15 and 6 prevents the rotation of wobble plate 13.

Fixed bevel gear 6 has a shank portion 62 which extends into a central hole 111 formed in a central portion of cylinder block 11 and is non-rotatably fixed therein by a key 64 extending from shank portion 62 into a slot in cylinder block 11. Ball bearing element 18 has a spherical portion 181 and a cylindrical shank portion 182, which is non-rotatably fixed to fixed bevel gear 6. Bevel gears 15 and 6 each have ball seat portions 511 and 61 respectively disposed on ball bearing element 18. Drive shaft 5 passes through a center hole that extends through the spherical and shank portions of spherical member 18. Shank portion 62 is provided with a hollow portion 63 within which a coil spring 19 is disposed to push fixed bevel gear 6 toward oscillating bevel gear 15. Therefore, change of relationship between two bevel gears due to wearing of ball bearing element or the seated surfaces of the bevel gears will be compensated for by changing the position of fixed bevel gear 6 by the recoil strength of coil spring 19.

Cylinder block 11 is formed with a plurality of annularly arranged cylinders 112 which are equiangularly formed and slidably fitted pistons 16, respectively. All pistons 16 are connected to wobble plate 13 by connecting rods 17, i.e., one end of each connecting rod 17 is connected to wobble plate 13 with a ball joint, and the other end of each connecting rod 17 is connected to each piston 16 with a ball joint.

Cylinder head 3 is shaped to define a suction chamber 31 and discharge chamber 32. Valve plate 4 is provided with a plurality of suction ports 41 connecting between suction chamber 31 and the respective cylinders 112, and a plurality of discharge ports 42 connecting between discharge chamber 32 and respective cylinder 112.

In operation, drive shaft 5 is rotated by the external drive source, and cam rotor 9 is rotated together with drive shaft 5 to cause non-rotatably, wobbling motion of wobble plate 13 about ball bearing element 18. As wobble plate 13 moves, pistons 17 are reciprocated out of phase in their respective cylinders 112. By the reciprocation of pistons 16, the refrigerant gas is taken in, compresed and discharged from the cylinders 112.

In the disclosed compressor, the inner terminal end of drive shaft 5 penetrates through oscillating bevel gear 15, ball bearing element 18 and fixed bevel gear 6 and is supported in the center bore of the cylinder block through a radial needle bearing 8 in shank portion 62 of fixed bevel gear 6. Therefore, drive shaft 5 is rotatably supported by both its end portions through radial needle bearings. Thus, slanting motion of drive shaft due to compressing operation is prevented, and driving motion of the drive shaft is stabilized, to thereby reduce the load acting against the radial needle bearing disposed on the front end plate and the thrust needle bearing disposed between the front end plate and the cam rotor.

This invention has been described in detail in connection with the preferred embodiment, but this is example only and the invention is not restricted thereto. It will be easily understood, by those skilled in the art that other variations and modifications can be easily made within the scope of this invention.

I claim:

1. In a wobble plate type compressor including a compressor housing having a crank chamber and a cylinder block having an axial center bore and a plurality of cylinders axially equiangularly formed around the center bore, a front end plate attached to one end opening of said compressor housing, a cylinder head attached to the other end of said compressor housing, a plurality of pistons slidably fitted within each of said cylinders, a cam rotor disposed within said crank chamber to rotate together with a drive shaft, a wobble plate coupled to said pistons through connecting rods and disposed on the inclined surface of said cam rotor to convert rotating motion of said cam rotor into reciprocating motion of said pistons; the improvement comprising a first bevel gear non-rotatably disposed within said crank chamber in alignment with said center bore of said cylinder block and having a first ball seat portion, a second bevel gear connected to said wobble plate and having a second ball seat portion, said drive shaft comprising a single integral member extending through said cam rotor and wobble plate to be rotatably supported in said center bore, a spherical member carried on said drive shaft in said crank chamber, said first and second seat portions of said first and second bevel gears being disposed on said spherical member and intermeshing with one another whereby the rotation of said second bevel gear and said wobble plate is prevented by said non-rotatable first bevel gear.

2. A wobble plate compresor in accordance with claim 1 wherein said drive shaft is supported by a bearing located within an opening in said front end plate.

3. A wobble plate compressor in accordance with claim 1 wherein said first bevel gear includes a shank portion extending in said center bore, said shank portion having a hollow portion for rotatably supporting an end of said drive shaft.

4. A wobble plate compressor in accordance with claim 3 wherein said shank portion of said first bevel gear includes a key extending into a slot in said cylinder block.

5. A wobble plate compressor in accordance with claim 3 wherein said drive shaft is supported by a bearing located within an opening in said front end plate.

6. A wobble plate compressor in accordance with claim 3 wherein said drive shaft is supported within said hollow portion of said shank portion by a bearing.

7. In a wobble plate type compressor including a compressor housing having a crank chamber and a cylinder block having an axial center bore and a plurality of cylinders axially equiangularly formed around the center bore, a front end plate attached to one end opening of said compressor housing, a cylinder head attached to the outer end of said compressor housing, a plurality of pistons slidably fitted within each of said cylinders, a cam rotor disposed wtihin said crank chamber to rotate together with a drive shaft, a wobble plate coupled to said pistons through connecting rods and disposed on the inclined surface of said cam rotor to convert rotating motion of said cam rotor into reciprocating motion of said pistons, the improvement comprising a first bevel gear non-rotatably disposed within said crank chamber in alignment with said center bore of said cylinder block and having a first ball seat portion and a shank portion, said shank portion extending into said center bore and having a hollow portion, a second bevel gear connected to said wobble plate and having a second ball seat portion, said drive shaft extending through said cam rotor and wobble plate and having one end rotatably supported within said hollow portion of said shank portion, a spherical member carried on said drive shaft in said crank chamber and including a spherical portion and a cylindrical shank portion, said drive shaft extending through a center hole passing through both said spherical and said shank portion of said spherical member, said first and second ball seat portions of said first and second bevel gears being disposed on said spherical member and intermeshing with one another whereby the rotation of said second bevel gear and said wobble plate is prevented by said non-rotatably first bevel gear.

8. A wobble plate compressor in accordance with claim 7 wherein said cylindrical shank portion of said spherical member is non-rotatably fixed to said first bevel gear.

* * * * *